United States Patent [19]

Suzuki et al.

[11] Patent Number: 4,731,322

[45] Date of Patent: Mar. 15, 1988

[54] LIGHT-SENSITIVE SILVER HALIDE PHOTOGRAPHIC MATERIAL FOR X-RAY PHOTOGRAPHY

[75] Inventors: Akio Suzuki; Masatoshi Iwata; Katsutoshi Machida; Chika Honda, all of Hino, Japan

[73] Assignee: Konishiroku Photo Industry Co., Ltd., Tokyo, Japan

[21] Appl. No.: 892,889

[22] Filed: Jul. 29, 1986

Related U.S. Application Data

[63] Continuation of Ser. No. 609,891, May 14, 1984, abandoned.

[30] Foreign Application Priority Data

May 20, 1983 [JP] Japan ..... 58-87609

[51] Int. Cl.[4] ..... G03C 1/02; G03C 5/24

[52] U.S. Cl. ..... 430/567; 430/621; 430/966; 430/967

[58] Field of Search ..... 430/966, 967, 567, 621

[56] References Cited

U.S. PATENT DOCUMENTS

| | | | |
|---|---|---|---|
| 3,942,986 | 3/1976 | Florens | 430/567 |
| 3,989,527 | 11/1976 | Locker | 430/567 |
| 4,222,777 | 9/1980 | Nakajima et al. | 430/363 |
| 4,414,304 | 11/1983 | Dickerson | 430/567 |
| 4,425,426 | 1/1984 | Abbott et al. | 430/567 |
| 4,446,228 | 5/1984 | Honda et al. | 430/567 |
| 4,521,507 | 6/1985 | Iijima et al. | 430/503 |

OTHER PUBLICATIONS

Eastman Kodak Co., "Sensitometric Properties of X-ray Films," 1963, pp. 2–14.

Agfa-Gevaert Rex, Inc., "Curix® RP1 Film," 1982, pp. 1–4.

Dupont, "Cronex® 7 Medical X-Ray Film, pp. 1–4.

*Primary Examiner*—Paul R. Michl

*Assistant Examiner*—Patrick A. Doody

*Attorney, Agent, or Firm*—Frishauf, Holtz, Goodman & Woodward

[57] ABSTRACT

A light-sensitive silver halide photographic material for X-ray photography characterized in that the material has the characteristic curve whose gamma between optical densities of 0.50 and 1.50 is 2.7 to 3.3 and gamma between optical densities of 2.00 and 3.00 is 1.5 to 2.5, when processed by use of the following developer:

| | |
|---|---|
| Potassium sulfite | 55.0 g |
| Hydroquinone | 25.0 g |
| 1-Phenyl-3-pyrazolidone | 1.2 g |
| Boric acid | 10.0 g |
| Potassium hydroxide | 21.0 g |
| Triethylene glycol | 17.5 g |
| 5-Methylbenztriazole | 0.04 g |
| 5-Nitrobenzimidazole | 0.11 g |
| 1-Phenyl-5-mercaptotetrazole | 0.015 g |
| Glacial acetic acid | 16.0 g |
| Potassium bromide | 4.0 g |
| Add water to make up one liter. | |

6 Claims, 1 Drawing Figure

LIGHT-SENSITIVE SILVER HALIDE PHOTOGRAPHIC MATERIAL FOR X-RAY PHOTOGRAPHY

This application is a continuation of application Ser. No. 609,891, filed May 14, 1984, now abandoned.

BACKGROUND OF THE INVENTION

This invention relates to a light-sensitive silver halide photographic material for X-ray photography, having high diagnosis ability. More particularly, it relates to a light-sensitive silver halide photographic material for X-ray photography, having wide exposure latitude to make the material easy to use and capable of producing images of such high sharpness as to readily make the diagnosis.

In X-ray photographing of every parts of a living body by use of a light-sensitive silver halide photographic material for X-ray photography (hereinafter referred to merely as "X-ray sensitive material" including those to be classified into a material having light-sensitive emulsion layers on both sides of a substrate and a material having a light-sensitive emulsion layer on one side of a substrate), it is required for the X-ray sensitive material to have high diagnosis ability in order to make an early detection of a focus (a localized area of disease) and prevent erroneous diagnosis. However, conventional X-ray sensitive materials are not necessarily satisfactory to this effect.

Namely, in the conventional direct X-ray sensitive materials, which are roughly classified into a high gamma type represented by (a), a low gamma type represented by (b) and a middle type represented by (c) in the photographic characteristic curves shown in FIG. 1, respectively, the high gamma type (a) has high sharpness, but has too narrow exposure latitude to use easily; the low gamma type (b) has, on the contrary, so wide exposure latitude as to be easy to use, but has too low sharpness to make diagnosis; and the middle type (c) has only middling sharpness and middling exposure latitude.

When the direct X-ray sensitive materials of these types are processed by use of the same developer as used in this invention, typical examples of the gamma (Gamma-1) between optical densities of 0.50 and 1.50 and the gamma (Gamma-2) between optical densities of 2.00 and 3.00 on the photographic characteristic curve can be shown as in Table 1.

TABLE 1

| | Gamma 1 D = 0.50–1.50 | Gamma 2 D = 2.00–3.00 |
|---|---|---|
| High gamma type: | 2.6 to 3.0 | 2.8 to 3.5 |
| Middle type: | 2.4 to 2.7 | 2.5 to 3.0 |
| Low gamma type: | 2.0 to 2.2 | 1.2 to 1.5 |

In actual examples of the X-ray photography using these conventional types of the direct X-ray sensitive materials, even serious defects or incovenience such as follows have been caused: One of the living body parts of which X-ray photographs are most frequently taken is a the stomach, where a contrast medium is used in order to enhance the image depictivity. In the case of the conventional high gamma type direct X-ray sensitive material, where the exposure is adjusted to the contrast medium itself, no image other than entirely black image is obtained, after development, in respect of the part having no contrast medium. Thus, these materials have not been contributory at all to making any diagnosis. In order to prevent such a consequence, there have been frequently used low gamma type direct X-ray sensitive materials. In this case of this X-ray sensitive materials, however, the sharpness is lowered on the contrary and therefore the diagnosis ability decreases for the part of stomach wall containing the contrast medium. In another example for X-ray photographing of other parts of a living body, the X-ray photographs are taken of bones such as hands and legs and soft tissues such as flesh and cartilages. In these cases also, the conventional high gamma type X-ray sensitive materials may be useful for attaining high sharpness in respect of fine structures of bones, but may result in entirely black image in respect of soft tissues, and therefore have not been contributory to making the diagnosis. On the contrary, when the low gamma type X-ray sensitive materials are used, the soft tissues can be imaged, but the sharpness of images of bones are lowered.

SUMMARY OF THE INVENTION

Figure 1:
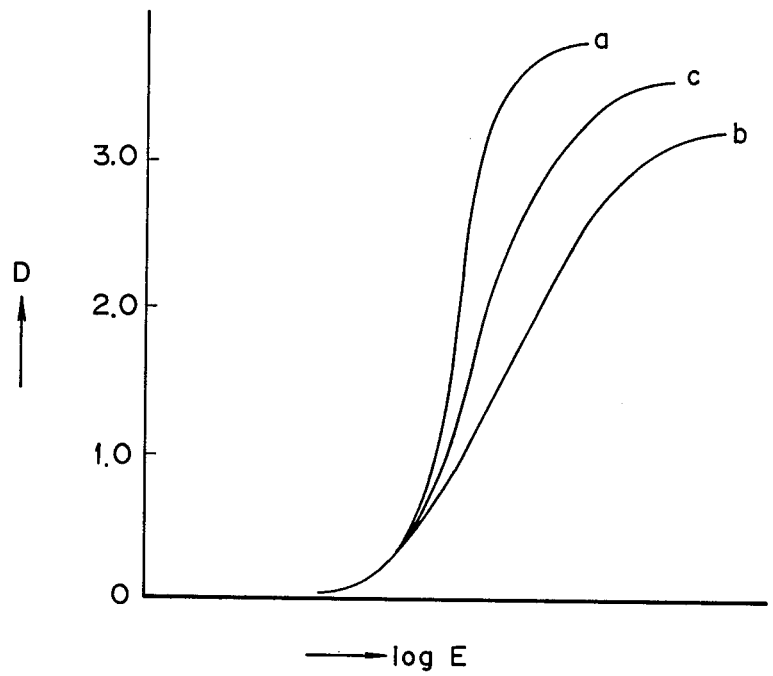
FIG. 1 is a graph showing the photographic characteristic curve of a conventional direct X-ray sensitive material, in which (a) denotes a high gamma type, (b) a low gamma type, and (c) a middle type.

Accordingly, it is an object of this invention to provide an X-ray sensitive material capable of producing images of high sharpness, having wide exposure latitude at a high density portion, and having high diagnosis ability.

To achieve the above object, the X-ray sensitive material according to this invention is characterized in that the material has the characteristic curve whose gamma between optical densities of 0.50 and 1.50 is 2.7 to 3.3 and gamma between optical densities of 2.00 and 3.00 is 1.5 to 2.5, when processed by use of Developer-I having the composition shown below.

Developer-I:

| | |
|---|---|
| Potassium sulfite | 55.0 g |
| Hydroquinone | 25.0 g |
| 1-Phenyl-3-pyrazolidone | 1.2 g |
| Boric acid | 10.0 g |
| Potassium hydroxide | 21.0 g |
| Triethylene glycol | 17.5 g |
| 5-Methylbenztriazole | 0.04 g |
| 5-Nitrobenzimidazole | 0.11 g |
| 1-Phenyl-5-mercaptotetrazole | 0.015 g |
| Glacial acetic acid | 16.0 g |
| Potassium bromide | 4.0 g |
| Add water to make up one liter. | |

DESCRIPTION OF THE PREFERRED EMBODIMENTS

In a more preferred embodiment of this invention, the material having been processed by the Developer-I has the characteristic curve whose gamma between optical densities of 0.50 and 1.50 is 2.8 to 3.1 and the gamma between optical densities of 2.00 and 3.00 is 1.7 to 2.3.

The characteristic curve referred to in this invention is obtained by the following photosensitometry [A].

Photosensitometry [A]:

An X-ray sensitive material comprising a transparent support whose both sides (or one side) are provided with a light-sensitive emulsion layer is interposed between two pieces of optical wedges, and exposed to light for 1/10 second from both sides thereof simultaneously and in an equal quantity of light by use of a light source having color temperature of 5,400° K. Processing is carried out by the following procedures and by use of an automatic processor of a roller transport type or the like.

| | Processing temperature | Processing time |
|---|---|---|
| Development: | 35° C. | 25 seconds |
| Fixing: | 34° C. | 25 seconds |
| Washing: | 33° C. | 25 seconds |
| Drying: | 45° C. | 15 seconds |

Development solution herein used is the aforementioned Developer-I. Fixing solution may not be limited to a specific one if it is an acidic hardening fixer; Sakura XF (produced by Konishiroku Photo Industry Co., Ltd.) may be used, for example.

The gamma referred to in this invention denotes the slope of the straight line portion connecting a point of the density of the base (or support) density plus 0.50 with a point of the density of the base density plus 1.50, and also the slope of the straight line portion connecting a point of the density of the base density plus 2.00 with a point of the density of the base density plus 3.00. More specifically, assuming as $\theta$ the angle at which these straight lines cross the exposure quantity axis (abscissa), it is represented by $\gamma = \tan \theta$.

The characteristic curve according to this invention may be obtained by any desirable methods applying techniques such as those employing a monodispersed emulsion, a polydispersed emulsion, a core/shell type monodispersed emulsion or a core/shell type polydispersed emulsion singly or in combination of two or more of these, controlling the grain size and the grain size distribution, adapting the silver halide crystal habit, or utilizing additives for photography such as a hardening agent and a development controlling agent.

Examples of the methods for obtaining the characteristic curve according to this invention include the following:

A first instance is a method in which there is employed a silver halide emulsion comprising a mix of two or more kinds, preferably two kinds, of monodispersed emulsions having mean grain sizes different from each other, which are chemically sensitized and then mixed with each other in a prescribed ratio. The mean grain sizes of the two kinds of the monodispersed emulsions may range from 0.3 to 1.35 μm and differentiate in such a mean grain size ratio of one of them to the other as being 1:1.2 to 1:2.4. More preferably, one of the above monodispersed emulsions is a monodispersed emulsion containing silver halide grains of a larger mean grain size and the other is a monodispersed emulsion containing silver halide grains of a smaller mean grain size, and the desired characteristic curve can be obtained by chemically sensitizing these monodispersed emulsions to the optimum, followed by mixing them preferably in the ratio of 2:1 to 5:1 as molar ratio of silver halide. For example, it can be obtained by chemically sensitizing to the optimum a monodispersed emulsion (preferably of a core/shell type) containing grains of a mean grain size of 1.35 μm and a monodispersed emulsion (preferably of a core/shell type) containing grains of a mean grain size of 0.65 μm, respectively, followed by mixing them in the ratio of 3:1 as molar ratio of silver halide. Another example of the mixing may comprise chemically sensitizing to the optimum a monodispersed emulsion (preferably of a core/shell type) containing grains of a mean grain size of 1.25 μm and a monodispersed emulsion (preferably of a core/shell type) containing grains of a mean grain size of 0.75 μm, respectively, followed by mixing them in the ratio of 4:1 as molar ratio of silver halide.

A second instance is a method comprising mixing a monodispersed emulsion containing grains of a larger mean grain size and a monodispersed emulsion or polydispersed emulsion, preferably a polydispersed emulsion, containing silver halide grains of a smaller mean grain size, which are chemically sensitized and then mixed with each other in a prescribed ratio. The mean grain sizes of the polydispersed emulsion and the monodispersed emulsion may range from 0.3 to 1.35 μm and differentiate in such a mean grain size ratio of the former to the latter as being 1:1.2 to 1:2.4. The desired characteristic curve can be obtained by chemically sensitizing the above polydispersed emulsion and the monodispersed emulsions to the optimum, followed by mixing them with each other preferably in the ratio of 2:1 to 5:1 as molar ratio of silver halide. For example, it can be obtained by chemically sensitizing a monodispersed emulsion containing grains of mean grain size of 1.35 μm and a polydispersed emulsion containing grains of a mean grain size of 0.75 μm, respectively, followed by mixing them in the ratio of 3:1 as molar ratio of silver halide. Another example of the mixing may comprise chemically sensitizing to the optimum a monodispersed emulsion containing grains of a mean grain size of 1.15 μm and a polydispersed emulsion containing grains of a mean grain size of 0.55 μm, respectively, followed by mixing them in the ratio of 4:1 as molar ratio of silver halide. The silver halide used in these method is preferably of a core/shell type, also.

A third instance is a method in which, for example, a hardening agent is used in a large amount in a light-sensitive silver halide emulsion (preferably a monodispersed emulsion, in particular, a core/shell type monodispersed emulsion of a mean grain size of 0.3 to 1.35 μm) having very high gamma (of 3.0 to 5.0), thereby enhancing the hardness. Namely, by enhancing the hardness, the gamma is lowered farther at a high density portion of the characteristic curve than at a middle density portion thereof. Kinds of hardening agent and application methods for using the same may be selected from those known in the art of photography, and there may be employed, for example, aldehyde compounds, ketone compounds, halo-substituted acids such as mucochloric acid, ethyleneimine compounds, vinylsulfone compounds, etc.

A fourth instance is a method in which a development restrainer is added to a light-sensitive silver halide emulsion (preferably a monodispersed emulsion, in particular, a core/shell type monodispersed emulsion) having very high gamma, thereby making soft the contrast at the high density portion of the characteristic curve predominantly. Kinds of the development restrainer and application methods for using the same may be selected from those known in the art of photography, and there may be preferably employed, for example, indazole compounds, mercapto-succinic acid compounds, etc.

The monodispersed emulsion used in the above first and second methods according to this invention preferably comprises a silver halide emulsion in which at least 95% by grain number or weight of grains have a grain size within the range of ±40%, more preferably ±30%, of the mean grain size, provided that the mean grain size has been determined by the method reported in The Photographic Journal, 79, 330–338 (1939) by Trevelli and Smith.

Method for preparing such a monodispersed emulsion is known in the art as disclosed in the publications, for example, J. Phot. Sci., 12, 242–251 (1963), Japanese Patent Publication (KOKOKU) No. 36890/1973 and Japanese Unexamined Patent Publication (KOKAI) No. 142329/1980. A technique disclosed in the specification of Japanese Unexamined Patent Publication (KOKAI) No. 179835/1982 (Patent Application No. 65573/1981) may be also employed.

The silver halide emulsion used in this invention may be of core/shell type monodispersion. A core/shell type emulsion is known in the art as disclosed in Japanese Unexamined Patent Publication (KOKAI) No. 48521/1979.

The silver halide grains used in this invention may be prepared by, for example, a neutral method, an acidic method, an ammoniacal method, a single jet method, a double jet method, a controlled double jet method, a conversion method, a core/shell method, etc. which are disclosed in T. H. James, "The Theory of the Photographic Process", 4th ed., published by Macmillan Co., (1977), pp 38–104, etc. For the composition of the silver halide, there may be used any of silver chloride, silver bromide, silver chlorobromide, silver iodobromide and silver chloroiodobromide, but it is most preferred to use a silver iodobromide emulsion containing not more than about 10 mole % of silver iodide. Grain size of the silver halide grains may not be limited in particular, but it is preferably 0.1 to 2μ. The silver halide grains or the silver halide emulsion may further contain iridium salt and/or rhodium salt for the purpose of improving the flash exposure characteristic.

As a hydrophilic protective colloid which is a dispersing agent of the silver halide, gelatin is preferred. Every kind of other natural or synthetic colloidal substances such as gelatin derivatives, polyvinyl alcohols, etc. may be also used singly or in combination with the gelatin.

Sensitizers advantageously employable in this invention can be roughly classified into four groups comprising metallic sensitizers including gold compounds, ruthenium, rhodium, palladium, iridium, platinum, etc.; sulfur sensitizers including activated gelatins, sulfur compounds, etc.; selenium sensitizers including activated selenium compounds, inert selenium compounds, etc.; and reduction sensitizers including bivalent tin compounds, polyamines, silane compounds, bisalkylaminosulfides, iminoaminomethane sulfinic acids, hydrazinium salts, hydrazine derivatives, etc. These sensitizers may be used singly or in suitable combination to chemically sensitize the emulsions. If necessary, dyes may be further used singly or in combination to make spectral sensitization or color strengthening sensitization.

In this invention, the silver halide emulsion layer may contain a stabilizer including triazoles, tetrazoles, imidazoles, azaindenes, quarternary benzothiazolium compounds, zinc or cadmium compounds, etc. It may further contain a sensitizing compound of a quaternary ammonium salt type or a polyethylene glycol type. Furthermore, it may also contain a suitable gelatinous plasticizer including dihydroxyalkanes such as glycerol and 1,5-pentanediol, ethylene bisglycolic acid esters, bis-ethoxydiethylene glycol succinates, acrylic acid series acid amides, latexes, etc. It may also contain other various additives for photography such as the hardening agent mentioned above, a spreading agent such as saponin, a coating aid such as sulfosuccinate, etc. If necessary, it may still further contain additives usually used in the photography, such as an antifoggant and a ultraviolet absorbing agent, etc.

The X-ray sensitive material according to this invention may further contain dyes for preventing irradiation and corrosion.

As a support used for the X-ray sensitive material according to this invention, there may be employed various kinds of supports including a polyester film such as a polyethlenephthalate film, a polyamide film, a ploycarbonate film, a stylene film, etc. These may be dyed blue, for example, and may be selected in accordance with their purposes.

This invention can attain at the same time both the high sharpness and the wide exposure latitude at the high density portion. Accordingly it is possible to provide an X-ray sensitive material having high diagnosis ability and, in particular, eliminate the defects inherent to the conventional materials for the photographing of stomach part using a contrast medium and the photographing of bones and soft tissues.

This invention will be exemplified below by referring to the following Examples, to which, however, the embodiments of the invention are not limited.

EXAMPLE 1

To an aqueous gelatin solution were added a potassium bromide solution containing 2.5 mole % of potassium iodide and an ammoniacal silver nitrate solution by a double jet method while gradually accelerating the flow rate to prepare a monodispersed silver iodide emulsion of regular octahedral grains having a mean grain size of 1.05 μm. To the emulsion were further added an ammoniacal silver nitrate solution and a potassium bromide solution by the double jet method to provide shells comprising silver bromide alone. During these steps, pAg was maintained at 10.0 and pH was made gradually lowered from 9.0 to 8.0. The emulsion thus obtained was designated as Emulsion [A]. The emulsion [A] was confirmed to be a monodispersed silver iodobromide emulsion of regular octahedral grains having a mean grain size of 1.25 μm.

In the same method for obtaining the above Emulsion [A], an Emulsion [B] was also prepared which is a monodispersed silver iodobromide emulsion of regular octahedral grains having a mean grain size of 0.65 μm.

Further, a silver iodobromide emulsion having the same composition as Emulsion [A] and [B] was prepared by a single jet method to obtain Emulsion [C], which was confirmed to be a twined crystal type polydispersed emulsion of a mean grain size of 1.25 μm.

Still further, in the same method to prepare Emulsion [C], Emulsion [D] was obtained which is a twined crystal type polydispersed emulsion of a mean grain size of 0.65 μm.

After desalting, these emulsions were subjected to gold sensitization and sulfur sensitization, stabilized by addition of 4-hydroxy-6-methyl-1,3,3a,7-tetrazaindene, and then mixed in the ratio as shown in Table 2. After further addition of ordinary photographic additives such as a spreading agent and a hardening agent, each of the mixed emulsions was applied by coating on both sides of a base made of polyethyleneterephthalate film which was dyed blue and undercoating-processed in advance, to have on each side thereof a silver amount of 30 mg/100 $cm^2$, and dried to produce samples of direct photographing X-ray sensitive materials, Sample Nos. 1 to 10.

Sensitometry of each of these samples were carried out according to the aforementioned Photosensitometry [A] employing the Developer-I of this invention. Development was made by use of a roller transport type processor New QX-1200 (manufactured by Konishiroku Photo Industry Co., Ltd.).

Results of the above are shown in Table 2, in which evaluation for the sharpness is represented by values 1.0, 1.5 and 2.0 lines/mm on OTF curve, respectively. Measurement of the OTF was performed by bringing a OTF measuring chart containing rectangualr wave patterns made of lead into direct contact with the back face of the front side of a fluorescent screen, irradiating it with X-ray so that the density at the both faces of the specimen not shielded by the lead rectangular wave patterns may become 1.0, peeling off the emulsion on the face of the back side, and scanning the rectangular wave patterns on the other side in the direction vertical to the rectangular wave patterns by use of Sakura Microdensitometer-M-5 (manufactured by Konishiroku Photo Industry Co., Ltd.). In this instance, the aperture size was 230 μm in the parallel direction and 25 μm in the vertical direction of the rectangular wave, and the magnification was 100 times.

Evaluation of the exposure latitude is shown by the difference (logarithmic indication) between exposure quantity giving the optical density of base density plus fog density plus 2.00 and exposure quantity giving the optical density of base density plus fog density plus 3.00.

As is apparent from Table 2, samples of Sample Nos. 2 and 7 satisfying the conditions of this invention show high sharpness and, at the same time, wide exposure latitude at the high density portion.

EXAMPLE 2

Emulsion [A] used in Example 1 was chemically sensitized, coated and dried in the same manner as in Example 1 to obtain samples of Sample Nos. 11 to 14, provided that the amount of a hardening agent added was varied as shown in Table 3.

Sensitometry and evaluation of image quality were performed in the same manner as in Example 1. Results are shown in Table 3.

As is apparent from Table 3, samples of Sample Nos. 12 and 13 satisfying the conditions of this invention show high sharpness and, at the same time, wide exposure latitude at the high density portion.

Same results were obtainable when the hardening agent glyoxazole was replaced by S-triazine.

EXAMPLE 3

Preparation method of Emulsion [A] in Example 1 was repeated, except that pAg was maintained at 9.0, to obtain Emulsion [E]. The Emulsion [E] was confirmed to be a monodispersed emulsion of cubic grains having a mean grain size of 1.25 μm.

The Emulsion [E] was chemically sensitized, coated and dried in the same manner as in Example 1 to obtain samples of Sample Nos. 15 to 17, provided that development restrainers as shown in Table 4 were added to the additives in the emulsions.

Sensitometry and evaluation of image quality of these samples were made in the manner as in Example 1. Results are shown in Table 4.

As is apparent from Table 4, samples of Sample Nos. 15 to 17 satisfying the conditions of this invention show high sharpness and, at the same time, wide exposure latitude at the high density portion.

TABLE 2

| Sample | Mixing ratio of emulsions | | | | Gamma 1 | Gamma 2 | OTF (lines/mm) | | | Latitude |
|---|---|---|---|---|---|---|---|---|---|---|
| No. | [A] | [B] | [C] | [D] | D = 0.5 - 1.5 | D = 2.0 - 3.0 | 1.0 | 1.5 | 2.0 | D = 2.0 - 3.0 |
| 1 | 100 | 0 | 0 | 0 | 3.5 | 3.1 | 0.96 | 0.76 | 0.55 | 0.32 |
| 2 | 75 | 25 | 0 | 0 | 3.0 | 2.0 | 0.95 | 0.73 | 0.50 | 0.50 |
| 3 | 50 | 50 | 0 | 0 | 2.6 | 3.4 | 0.93 | 0.70 | 0.45 | 0.29 |
| 4 | 0 | 0 | 100 | 0 | 2.8 | 3.1 | 0.94 | 0.71 | 0.47 | 0.32 |
| 5 | 0 | 0 | 75 | 25 | 2.3 | 1.9 | 0.92 | 0.67 | 0.40 | 0.53 |
| 6 | 0 | 0 | 50 | 50 | 1.9 | 2.8 | 0.90 | 0.63 | 0.36 | 0.36 |
| 7 | 75 | 0 | 0 | 25 | 3.0 | 1.9 | 0.95 | 0.73 | 0.50 | 0.53 |
| 8 | 50 | 0 | 0 | 50 | 2.6 | 3.1 | 0.93 | 0.70 | 0.45 | 0.32 |
| 9 | 0 | 25 | 75 | 0 | 2.3 | 2.1 | 0.91 | 0.67 | 0.40 | 0.48 |
| 10 | 0 | 50 | 50 | 0 | 1.9 | 3.0 | 0.90 | 0.63 | 0.36 | 0.33 |

TABLE 3

| Sample No. | Amount of hardening agent Glyoxal (mg/gram gelatin) | Gamma 1 D = 0.5 - 1.5 | Gamma 2 D = 2.0 - 3.0 | OTF (1.5 lines/mm) | Latitude D = 2.0 - 3.0 |
|---|---|---|---|---|---|
| 11 | 1.30 | 3.9 | 3.8 | 0.77 | 0.26 |
| 1 | 1.50 | 3.5 | 3.1 | 0.76 | 0.32 |
| 12 | 1.70 | 3.2 | 2.4 | 0.75 | 0.42 |
| 13 | 1.90 | 2.9 | 1.8 | 0.72 | 0.56 |
| 14 | 2.10 | 2.5 | 1.3 | 0.69 | 0.77 |

TABLE 4

| Sample No. | Development restrainer | Gamma 1 D = 0.5–1.5 | Gamma 2 D = 2.0–3.0 | OTF (1.5 lines/mm) | Latitude D = 2.0–3.0 |
|---|---|---|---|---|---|
| 1 | blank | 3.5 | 3.1 | 0.76 | 0.32 |

TABLE 4-continued

| Sample No. | Development restrainer | Gamma 1 D = 0.5–1.5 | Gamma 2 D = 2.0–3.0 | OTF (1.5 lines/mm) | Latitude D = 2.0–3.0 |
|---|---|---|---|---|---|
| 15 | 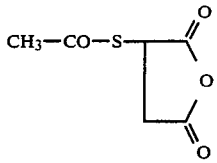 30 mg/AgX mol | 3.1 | 2.0 | 0.75 | 0.50 |
| 16 | 5-nitrobenztriazole 50 mg/AgX mol | 3.0 | 2.1 | 0.74 | 0.48 |
| 17 | 5-nitroindazole 50 mg/AgX mol | 3.0 | 2.0 | 0.74 | 0.50 |

We claim:

1. A method for preparing a light-sensitive silver halide photographic material for X-ray photography comprising chemically sensitizing a monodispersed silver halide emulsion and chemically sensitizing a polydispersed silver halide emulsion, said monodispersed emulsion containing grains of a larger mean grain size than the grains of said polydispersed emulsion and then mixing said monodispersed emulsion with said polydispersed emulsion, the mean grain sizes of said polydispersed emulsion and said monodispersed emulsion are from 0.3 to 1.35 μm and the ratio of the former to the latter is 1:1.2 to 1:2.4, thereby preparing a light-sensitive silver halide photographic material having a characteristic curve whose gamma between optical densities of 0.50 and 1.50 is 2.7 to 3.3 and gamma between optical densities of 2.00 and 3.00 is 1.5 to 2.5 when processed by the following Developer-I:

| | |
|---|---|
| Potassium sulfite | 55.0 g |
| Hydroquinone | 25.0 g |
| 1-Phenyl-3-pyrazolidone | 1.2 g |
| Boric acid | 10.0 g |
| Potassium hydroxide | 21.0 g |
| Triethylene glycol | 17.5 g |
| 5-Methylbenztriazole | 0.04 g |
| 5-Nitrobenzimidazole | 0.11 g |
| 1-Phenyl-5-mercaptotetrazole | 0.015 g |
| Glacial acetic acid | 16.0 g |
| Potassium bromide | 4.0 g |
| Water to make up one liter. | |

2. The method of claim 1, wherein the sensitized monodispersed emulsion and the sensitized polydispersed emulsion are mixed in the ratio of 2:1 to 5:1 as molar ratio of silver halide.

3. The method of claim 2, wherein the sensitized monodispersed emulsion and the sensitized polydispersed emulsion are mixed in the ratio of 3:1 to 4:1 as molar ratio of silver halide.

4. A method for preparing a light-sensitive silver halide photographic material for X-ray photography comprising chemically sensitizing a monodispersed silver halide emulsion of a mean grain size of 1.15 to 1.35 μm and chemically sensitizing a polydispersed silver halide emulsion of a mean grain size of 0.55 to 0.75 μm, and mixing said sensitized monodispersed emulsion with said polydispersed emulsion in the ratio of 3:1 to 4:1 as molar ratio of silver halide, thereby preparing a light-sensitive silver halide photographic material whose gamma between optical densities of 0.50 and 1.50 is 2.7 to 3.3 and gamma between optical densities of 2.00 and 3.00 is 1.5 to 2.5, when processed by use of the following Developer-I:

| | |
|---|---|
| Potassium sulfite | 55.0 g |
| Hydroquinone | 25.0 g |
| 1-Phenyl-3-pyrazolidone | 1.2 g |
| Boric acid | 10.0 g |
| Potassium hydroxide | 21.0 g |
| Triethylene glycol | 17.5 g |
| 5-Methylbenztriazole | 0.04 g |
| 5-Nitrobenzimidazole | 0.11 g |
| 1-Phenyl-5-mercaptotetrazole | 0.015 g |
| Glacial acetic acid | 16.0 g |
| Potassium bromide | 4.0 g |
| Water to make up one liter. | |

5. The light-sensitive silver halide photographic material for X-ray photography prepared by the process of claim 4 which has wide exposure latitude at the high density portion of said exposure and is capable of producing images of high sharpness which have high diagnostic utility.

6. The method of X-ray photography comprising imagewise exposing the light-sensitive silver halide photographic material of claim 5 to X-ray radiation to expose said material and then developing said exposed material to produce sharp photographic images.

* * * * *